US009224341B2

(12) United States Patent
Seetzen

(10) Patent No.: US 9,224,341 B2
(45) Date of Patent: Dec. 29, 2015

(54) COLOR DISPLAY BASED ON SPATIAL CLUSTERING

(71) Applicant: DOLBY LABORATORIES LICENSING CORPORATION, San Francisco, CA (US)

(72) Inventor: Helge Seetzen, Westmount, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 14/542,324

(22) Filed: Nov. 14, 2014

(65) Prior Publication Data

US 2015/0070409 A1 Mar. 12, 2015

Related U.S. Application Data

(63) Continuation of application No. 12/941,961, filed on Nov. 8, 2010, now Pat. No. 8,890,795, which is a continuation of application No. 11/722,706, filed as application No. PCT/CA2005/001975 on Dec. 23, 2005, now Pat. No. 7,830,358.

(60) Provisional application No. 60/638,122, filed on Dec. 23, 2004.

(51) Int. Cl.
*G09G 3/34* (2006.01)
*G09G 3/20* (2006.01)

(52) U.S. Cl.
CPC ..... *G09G 3/3413* (2013.01); *G09G 3/2003* (2013.01); *G09G 3/342* (2013.01); *G09G 3/3426* (2013.01); *G09G 2300/023* (2013.01); *G09G 2310/0235* (2013.01);

(Continued)

(58) Field of Classification Search
CPC ..... G09G 2310/0245; G09G 3/34–3/38
USPC ..... 345/76–104, 204–215, 690–699
See application file for complete search history.

(56) References Cited

U.S. PATENT DOCUMENTS 5,107,534 A 4/1992 Freyre
5,233,338 A * 8/1993 Surguy ..... G09G 3/3406 345/88

(Continued)

FOREIGN PATENT DOCUMENTS

CA 2025104 A1 3/1991
CA 1331060 7/1994

(Continued)

OTHER PUBLICATIONS

Yamada, F. et al., "Invited Paper: Color Sequential LCD Based on OCB with an LED Backlight", SID 00 Digest, pp. 1180-1183, 2000.

(Continued)

*Primary Examiner* — Patrick F Marinelli

(57) ABSTRACT

A color display has a monochrome modulator. An active area of the modulator is illuminated by an array of light sources. The light sources include light sources of three or more colors. The intensities of the light sources may be adjusted to project desired luminance patterns on an active area of the modulator. In a fast field sequential method different colors are projected sequentially. The modulator is set to modulate the projected luminance patterns to display a desired image. In a slow field sequential method, colors are projected simultaneously and the modulator is set to modulate most important colors in the image.

20 Claims, 4 Drawing Sheets

(52) U.S. Cl.
CPC ..... *G09G 2320/0646* (2013.01); *G09G 2320/0666* (2013.01); *G09G 2360/16* (2013.01)

(56) References Cited

U.S. PATENT DOCUMENTS

| | | | | |
|---|---|---|---|---|
| 5,359,345 | A | 10/1994 | Hunter | |
| 5,724,062 | A | 3/1998 | Hunter | |
| 5,734,362 | A | 3/1998 | Eglit | |
| 6,031,626 | A | 2/2000 | Shu et al. | |
| 6,091,849 | A | 7/2000 | Spaulding et al. | |
| 6,243,055 | B1 | 6/2001 | Fergason | |
| 6,448,951 | B1 | 9/2002 | Sakaguchi et al. | |
| 6,932,477 | B2 | 8/2005 | Stanton | |
| 7,064,740 | B2 * | 6/2006 | Daly | G09G 3/3426 345/102 |
| 7,176,879 | B1 * | 2/2007 | Yoshihara | G09G 3/3413 345/102 |
| 7,499,017 | B2 * | 3/2009 | Daly | G09G 3/3426 345/102 |
| 8,284,152 | B1 | 10/2012 | Lew et al. | |
| 2002/0057253 | A1 | 5/2002 | Lim et al. | |
| 2002/0060662 | A1 | 5/2002 | Hong | |
| 2002/0070914 | A1 | 6/2002 | Bruning et al. | |
| 2002/0113761 | A1 * | 8/2002 | Mizutani | G09G 3/3406 345/87 |
| 2002/0122019 | A1 | 9/2002 | Baba et al. | |
| 2002/0149576 | A1 | 10/2002 | Tanaka et al. | |
| 2002/0196220 | A1 | 12/2002 | Sato et al. | |
| 2003/0090455 | A1 * | 5/2003 | Daly | G09G 3/3426 345/102 |
| 2003/0231160 | A1 * | 12/2003 | Yoshihara | G09G 3/3648 345/102 |
| 2004/0012801 | A1 | 1/2004 | Murakami | |
| 2004/0046725 | A1 | 3/2004 | Lee | |
| 2004/0085496 | A1 | 5/2004 | Paukshto et al. | |
| 2004/0201561 | A1 | 10/2004 | Funamoto | |
| 2004/0246275 | A1 * | 12/2004 | Yoshihara | G09G 3/3413 345/690 |
| 2004/0264212 | A1 | 12/2004 | Chung et al. | |
| 2005/0001537 | A1 | 1/2005 | West et al. | |
| 2005/0052590 | A1 | 3/2005 | Ochiai et al. | |
| 2005/0062708 | A1 * | 3/2005 | Yoshihara | G09G 3/3406 345/96 |
| 2005/0162737 | A1 | 7/2005 | Whitehead et al. | |
| 2005/0185272 | A1 | 8/2005 | Whitehead et al. | |
| 2006/0126326 | A1 | 6/2006 | Ng et al. | |
| 2006/0146007 | A1 | 7/2006 | Lim et al. | |
| 2006/0158454 | A1 | 7/2006 | Heynderickx et al. | |
| 2006/0170645 | A1 | 8/2006 | Fisekovic et al. | |
| 2007/0001994 | A1 | 1/2007 | Roth | |
| 2011/0050559 | A1 * | 3/2011 | Seetzen | G09G 3/3413 345/102 |
| 2015/0070409 | A1 * | 3/2015 | Seetzen | G09G 3/3413 345/690 |

FOREIGN PATENT DOCUMENTS

| | | | |
|---|---|---|---|
| CA | 2354018 | A1 | 6/2000 |
| CN | 1422423 | A | 6/2003 |
| JP | 2001-142409 | A | 5/2001 |
| JP | 2001-196637 | A | 7/2001 |
| JP | 2002-099250 | A | 4/2002 |
| JP | 2002-532762 | A | 10/2002 |
| JP | 2003-077318 | A | 3/2003 |
| JP | 2004-191490 | A | 7/2004 |
| JP | 2004-333583 | A | 11/2004 |
| KR | 10-2004-0071958 | A | 8/2004 |
| WO | 9406249 | A1 | 3/1994 |
| WO | 02069030 | A2 | 9/2002 |
| WO | 03077013 | A2 | 9/2003 |
| WO | 2004107025 | A2 | 12/2004 |

OTHER PUBLICATIONS

Seetzen, H., et al., "A High Dynamic Range Display Using Low and High Resolution Modulators", SID 03 Digest, pp. 1450-1453, 2003.

* cited by examiner

COLOR DISPLAY BASED ON SPATIAL CLUSTERING

CROSS REFERENCE TO RELATED APPLICATION

This application is a continuation of U.S. patent application Ser. No. 12/941,961 filed 8 Nov. 2010, which is a continuation of U.S. patent application Ser. No. 11/722,706 filed on 22 Jun. 2007 now issued as U.S. Pat. No. 7,830,358, which is the US national stage of PCT international patent application No. PCT/CA2005/001975 filed on 23 Dec. 2005, which claims priority from U.S. patent application No. 60/638,122 filed on 23 Dec. 2004 all of which are hereby incorporated herein by reference. This application claims the benefit under 35 U.S.C. §119 of U.S. patent application No. 60/638,122 filed on 23 Dec. 2004.

TECHNICAL FIELD

The invention relates to displays for color images. The invention has application to color displays generally including computer displays, televisions, digital video projectors and the like.

BACKGROUND

A typical liquid crystal display (LCD) has a backlight and a screen made up of variable-transmissivity pixels in front of the backlight. The backlight illuminates a rear face of the LCD uniformly. A pixel can be made dark by reducing the transmissivity of the pixel. The pixel can be made to appear bright by increasing the transmissivity of the pixel so that light from the backlight can pass through. Images can be displayed on an LCD by applying suitable driving signals to the pixels to create a desired pattern of light and dark areas.

In a typical color LCD, each pixel is made up of individually controllable red, green and blue elements. Each of the elements includes a filter that passes light of the corresponding color. For example, the red element includes a red filter. When only the red element in a pixel is set to transmit light, the light passes through the red filter and the pixel appears red. The pixel can be made to have other colors by applying signals which cause combinations of different transmissivities of the red, green and blue elements.

Fluorescent lamps are typically used to backlight LCDs. PCT publication No. WO03077013A3 entitled HIGH DYNAMIC RANGE DISPLAY DEVICES discloses a high dynamic range display in which LEDs are used as a backlight.

There is a need for cost effective color displays. There is a particular need for such displays that provide high quality color images.

SUMMARY OF THE INVENTION

This invention has a number of aspects. One aspect of the invention provides methods for displaying images at a viewing area. The methods comprise providing an array comprising a plurality of groups of individually-controllable light sources, the light sources of each group emitting light of a corresponding one of a plurality of colors; driving the array in response to image data such that each of the groups projects a luminance pattern onto an active area of a modulator comprising a plurality of pixels; and, controlling the pixels of the modulator to selectively allow light from the active area to pass to the viewing area. The methods may display different color components of the image or different groups of color components of the image in a time-multiplexed manner.

Another aspect of the invention provides apparatus for displaying images at a viewing area. The apparatus comprises an array comprising a plurality of groups of individually-controllable light sources. The light sources of each group emit light of a corresponding one of a plurality of colors. The apparatus also includes a modulator having an active area comprising a plurality of pixels. The active area is illuminated by the array. Each pixel is controllable to vary a proportion of light incident on the active area that is passed to the viewing area. The apparatus also comprises a control circuit configured to drive each of the groups of the light sources according to a control signal to project a luminance pattern onto the active area of the modulator. The luminance pattern for each of the groups has a variation in intensity over the active area. In some embodiments the controller is configured to operate different ones of the groups or different sets of two or more of the groups in a time-multiplexed manner. In some embodiments of the invention the controller individually controls different parts of the array. In such embodiments of the invention, different ones of the groups or different sets of the groups may be active in different parts of the array during the same time interval.

Further aspects of the invention and features of specific embodiments of the invention are described below.

BRIEF DESCRIPTION OF THE DRAWINGS

In drawings which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
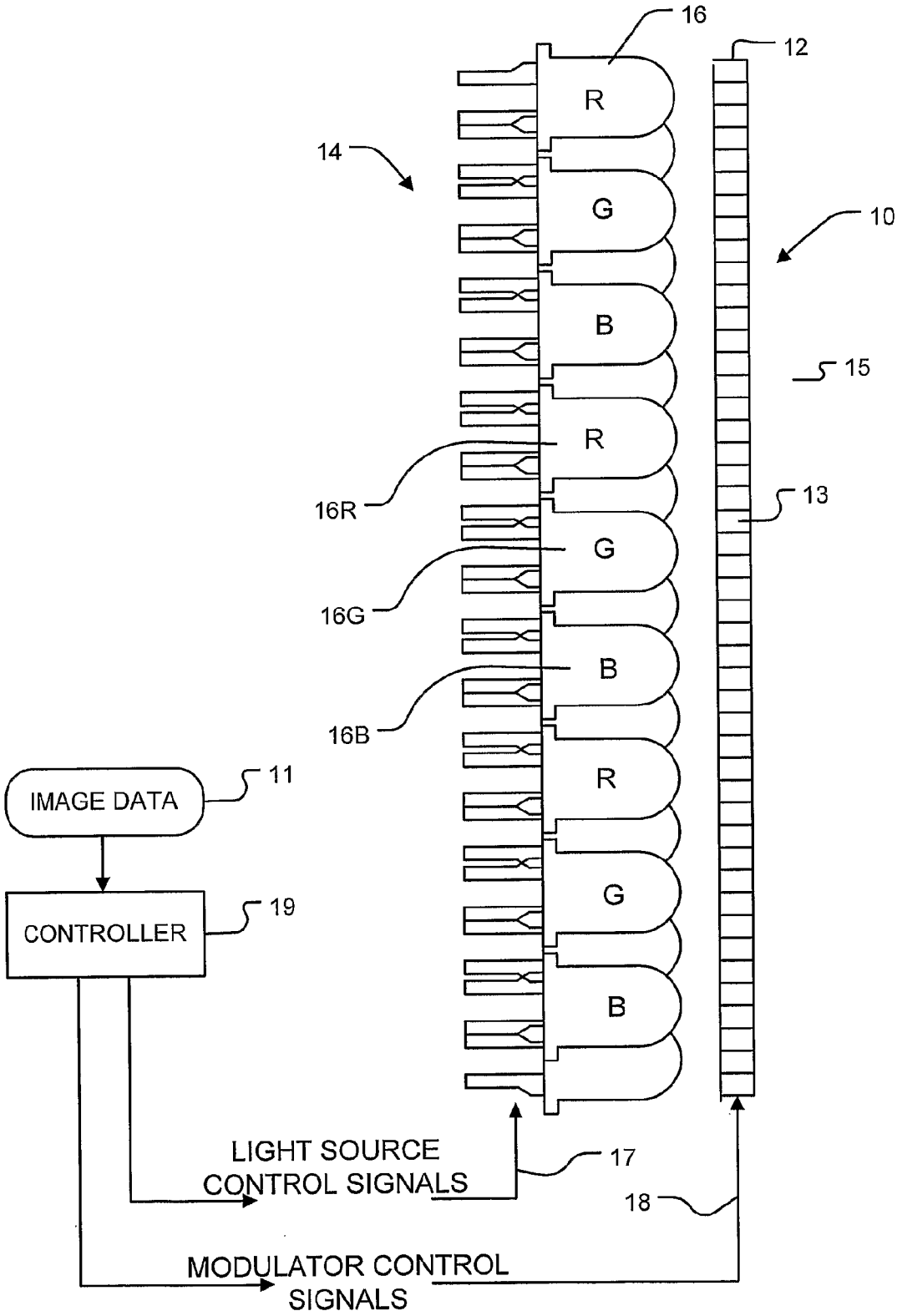
FIG. 1 is a schematic view of a display according to an embodiment of the invention.

FIG. 1 is a schematic view of a display 10 according to an embodiment of the invention. Display 10 comprises a modulator 12. Modulator 12 comprises a plurality of pixels 13. Modulator 12 modulates light from a backlight 14 comprising an array of light sources 16. In some embodiments of the invention, light sources 16 are light-emitting diodes (LEDs).

Modulator 12 may be a transmission-type modulator, such as an LCD panel, in which the amount of light transmitted through each pixel 13 can be varied, or a reflectance-type modulator. In some embodiments of the invention, modulator 12 comprises a gray-scale modulator such as a monochrome LCD panel or a digital mirror array.

Figure 2:
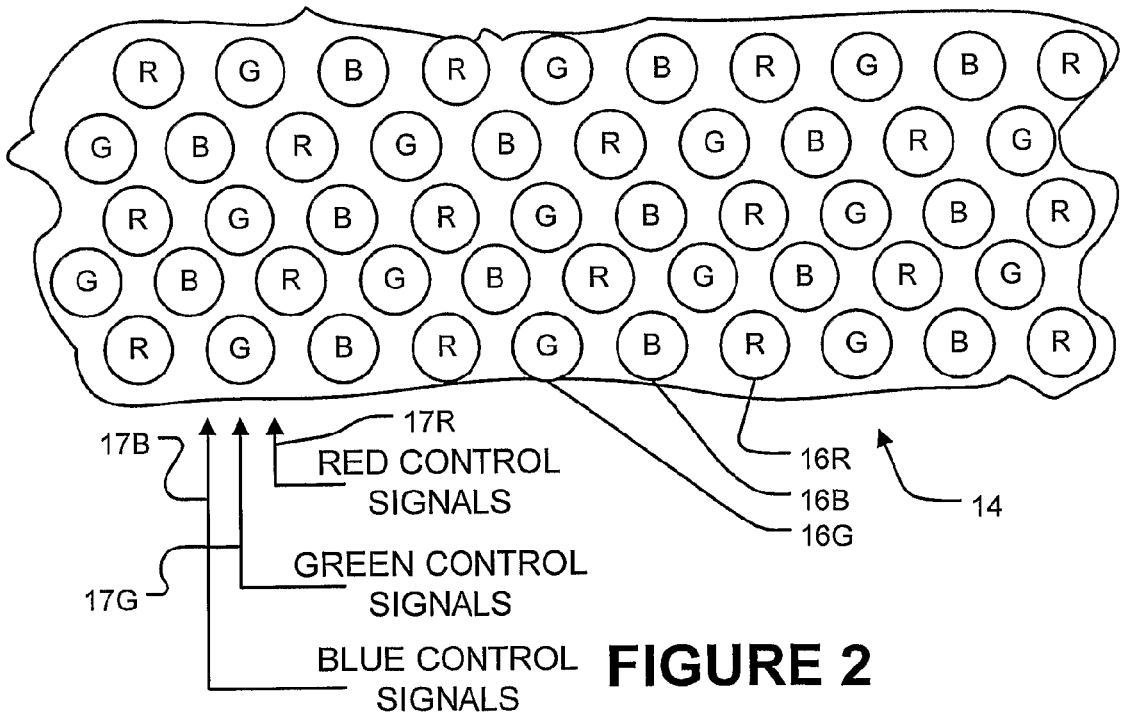
FIG. 2 is a schematic view of an array of light sources in an example display; and, FIG. 3 is a flow chart illustrating a slow field sequential imaging method.

The light sources of array 14 include independently-controllable light sources of each of a plurality of colors. The colors of the light sources can be combined with one another in different proportions to produce colors within a color gamut. For example, the colors may be red green and blue. These colors can be mixed to provide any color within the RGB color gamut. In the illustrated embodiment, the light sources comprise red light sources 16R, green light sources 16G and blue light sources 16B. The light sources are typically arranged so that light sources of each color are distributed substantially uniformly through array 14. FIG. 2 shows a possible arrangement of light sources in array 14.

The symmetrical arrangement of light sources 16 permits light sources 26 to provide relatively uniform illumination of the active area of modulator 12 with light of any one of the colors for which there are light sources 16. Preferably the point spread functions of adjacent light sources 16 of each color overlap with one another.

It is not necessary that the maximum intensity of all of light sources 16 be the same. For example, it is convenient to use LEDs for the light sources. LEDs of different colors tend to have different efficiencies. Typically the efficiency (the amount of light generated for a given electrical power) of green LEDs is greater than that of red LEDs. Typical red and green LEDs have greater efficiencies than typical blue LEDs. Up to a point, one can obtain brighter LEDs of any available color at greater expense. Those who design displays can select appropriate LEDs on the basis of factors such as maximum light output, electrical power requirements, and cost. Currently it is common to find it most cost effective to provide red, green and blue LEDs having flux ratios of approximately 3:5:1. With such a flux ratio, the red LEDs are three times brighter than the blue LEDs and the green LEDs are five times brighter than the blue LEDs.

In some embodiments of the invention, the number of light sources 16 of each color in array 14 is at least approximately inversely proportional to the flux ratio of the light sources. For example, where an array has light sources of three colors having flux ratios of 3:5:1, then the numbers of light sources of each of the three colors in the array could be in the ratio 5:3:15. The light sources of each color are substantially uniformly distributed on the array. In some embodiments, the point spread functions of the light sources of each color have widths that increase with the spacing between adjacent light sources of that color. The point spread functions of the light sources of one color may have widths that are in direct proportion to the spacing between adjacent light sources of that color in array 14. In some embodiments, a ratio of an average spacing between adjacent ones of the light sources in any one of the groups of light sources to a width of a point spread function of the light sources in the group of light sources is the same within ±20% for all of the groups of light sources in the array.

Each light source 16 illuminates at least part of the active area of modulator 12. Light sources 16 of different colors in different areas of array 14 are independently controllable. FIG. 2 shows light source control signals 17R, 17G and 17B which respectively control the intensities of light emitted by red, green and blue light sources in array 14. The intensities of light sources 16 in different areas of array 14 can be varied to project a desired luminance pattern onto the active area of modulator 12. The luminance pattern may be predicted by, for each point on the active area of modulator 12, adding together the luminance contributed by each of the light sources 16 that contributes significantly to the luminance at that point. In some embodiments, the luminance pattern may be predicted, for example, by estimating a pattern that would be produced on modulator 12 when light sources 16 are driven with particular driving signals. For example, estimating a luminance pattern for a point on the active area of modulator 12 may comprise determining estimated light outputs of each of the light sources 16 that contributes significantly to the luminance at that point.

Figure 1A:
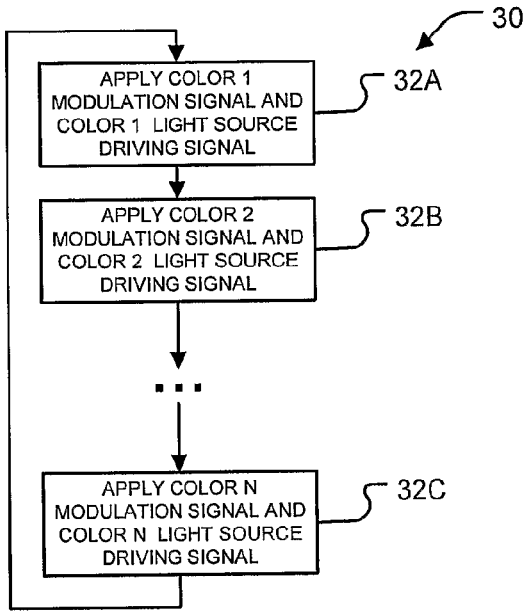
FIG. 1A is a flow chart illustrating a fast field sequential display method.

Display 10 may be operated to display a color image in a frame sequential mode wherein, the operation of the light sources in array 14 is time multiplexed. FIG. 1A discloses a simple frame sequential method 30 for practising the invention. In block 32A, a first modulator signal is applied to modulator 12 and a first light source driving signal is applied to those light sources 16 that are of the first color. The light sources 16 create a first luminance pattern of the first color on the active area of modulator 12. The first luminance pattern varies in intensity over the active area of modulator 12 according to data embodied in the first light source driving signal. The pixels 13 of modulator 12 further modulate the light as it passes to a viewing area 15. Where modulator 12 is a monochrome modulator, modulator 12 cannot correct individual colors by adjusting colour filter settings (since monochrome modulators generally lack color filters).

Method 30 sequentially executes blocks 32B and 32C which apply modulation and light source driving signals for other colors. After the last ($N^{th}$) set of modulation and light source driving signals has been applied, method 30 loops back to block 32A.

Preferably method 30 cycles through blocks 32A, 32B and 32C quickly enough that a person looking at viewing area 15 perceives a color image that does not flicker annoyingly. The human visual system generally ignores flicker that occurs at frequencies above roughly 50 Hz to 60 Hz.

In some embodiments of the invention, method 30 is repeated at a rate of at least 50 to 60 Hz. Where there are three colors (such as red, green and blue) this would require modulator 12 to operate at a rate of about 150 to 180 Hz. In cases where method 20 is used to drive a display 10 at relatively high rates then modulator 12 must be of a type that can support those rates.

Display may include a controller 19 that generates suitable light source control signals 17 and modulator control signals 18 to display a desired image. The desired image may be specified by image data 11 which directly or indirectly specifies color values for each pixel. Image data 11 may have any suitable format and may specify luminance and color values using any suitable color model. For example, image data 11 may specify:

red, green and blue (RGB) color values for each pixel;

YIQ values wherein each pixel is represented by a value (Y) referred to as the luminance and a pair of values (I, Q) referred to as the chrominance;

CMY or CMYK values;

YUV values;

YCbCr values;

HSV values; or

HSL values.

Figure 1B:
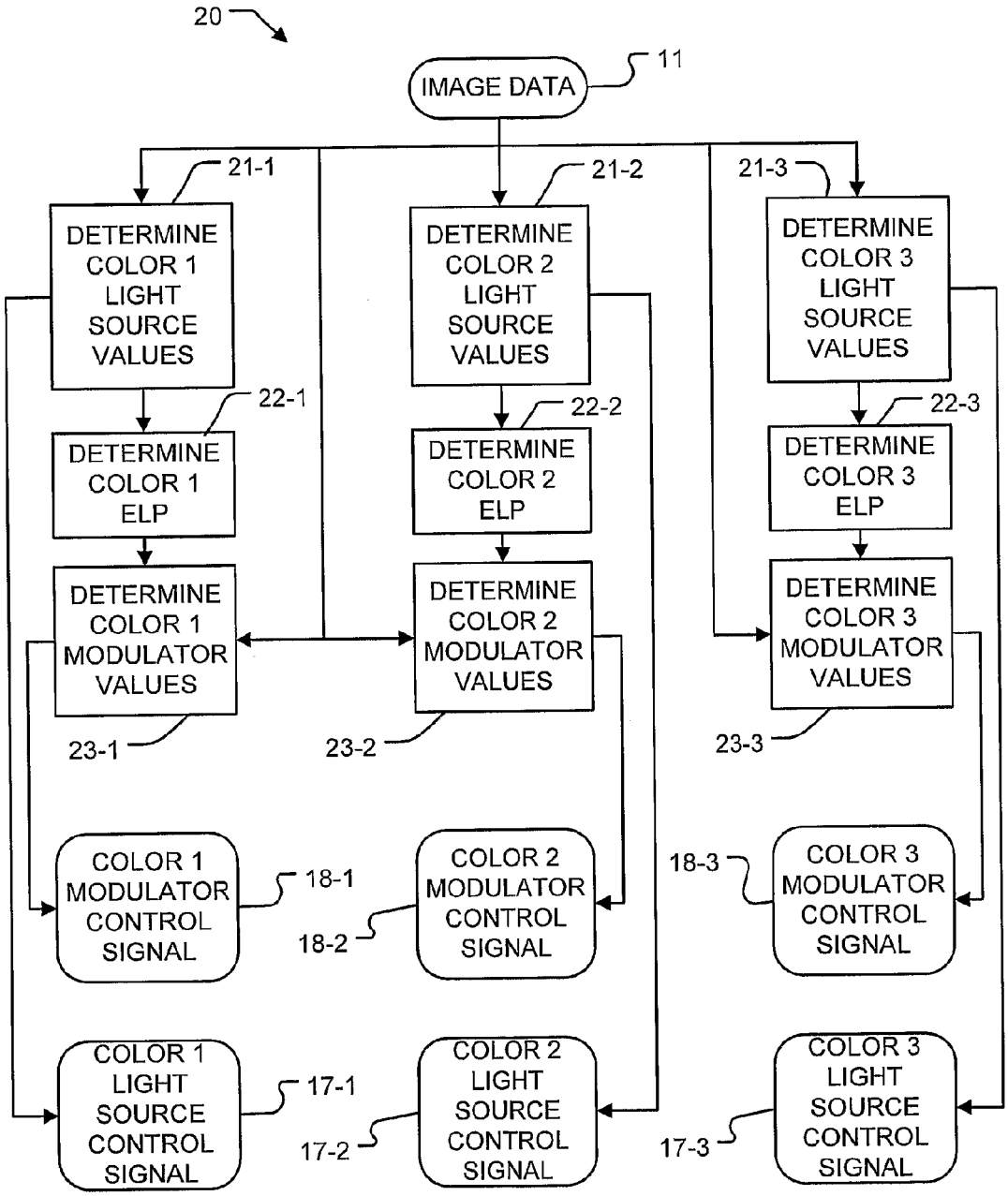
FIG. 1B is a flow chart illustrating a method for obtaining modulator and light source driving signals.

FIG. 1B shows a method 20 for generating light source control signals 17 and modulator control signals 18. Method 20 begins by generating light source control signals 17 from image data 11. This is performed separately in blocks 21-1, 21-2 and 21-3 for each color of light source in array 14. In the embodiment of FIG. 1B, light source control signals 17 include signals 17-1, 17-2 and 17-3, each of which controls one color of LED in array 14.

Light source control signals 17 may be generated by determining in controller 19 an intensity for driving each of LEDs 16 such that light sources 16 project desired luminance patterns onto the active area of modulator 12 for each color. Preferably, for each of the colors, the luminance of the luminance pattern at each pixel 13 is such that a luminance specified for that pixel 13, for that color, by image data 11 can be achieved within the range of modulation of the pixel. That is, it is desirable that the luminance L be such that:

$$L \times T_{MIN} \leq L_{IMAGE} \leq L \times T_{MAX} \quad (1)$$

where: $T_{MIN}$ is the minimum transmissivity of a pixel; $T_{MAX}$ is the maximum transmissivity of the pixel; and $L_{IMAGE}$ is the luminance for the pixel for that color specified by image data 11.

Controller 19 may generate modulator control signals 18 by, for each color, for each pixel 13 of modulator 12, dividing the desired luminance specified by image data 11 by the luminance at that element provided by array 14 when driven by the component of light source control signal 17 for that color.

The luminance provided by light source array 14 may be termed an effective luminance pattern ELP. Since each color is applied at a separate time, the ELP may be computed separately for each color and the computation to determine modulator control signals 18 may be performed independently for each color.

Method 20 computes ELPs for each color of light in blocks 22-1, 22-2, and 22-3. Method 20 determines the modulator control signal for each color in blocks 23-1, 23-2 and 23-3. In the embodiment of FIG. 1B, modulator control signals 18 include signals 18-1, 18-2 and 18-3 which respectively control the modulator to modulate light from the light sources of first, second and third colors in array 14.

It can be appreciated that method 30 can be energy efficient for a number of reasons including:

- Modulator 14 may be a monochrome modulator. Monochrome modulators can be made so that a greater proportion of the active area of the modulator is effective to pass light than is possible for typical color modulators.
- Where modulator 14 is a monochrome modulator, no light is absorbed in color filters in the modulator.

Figure 3:
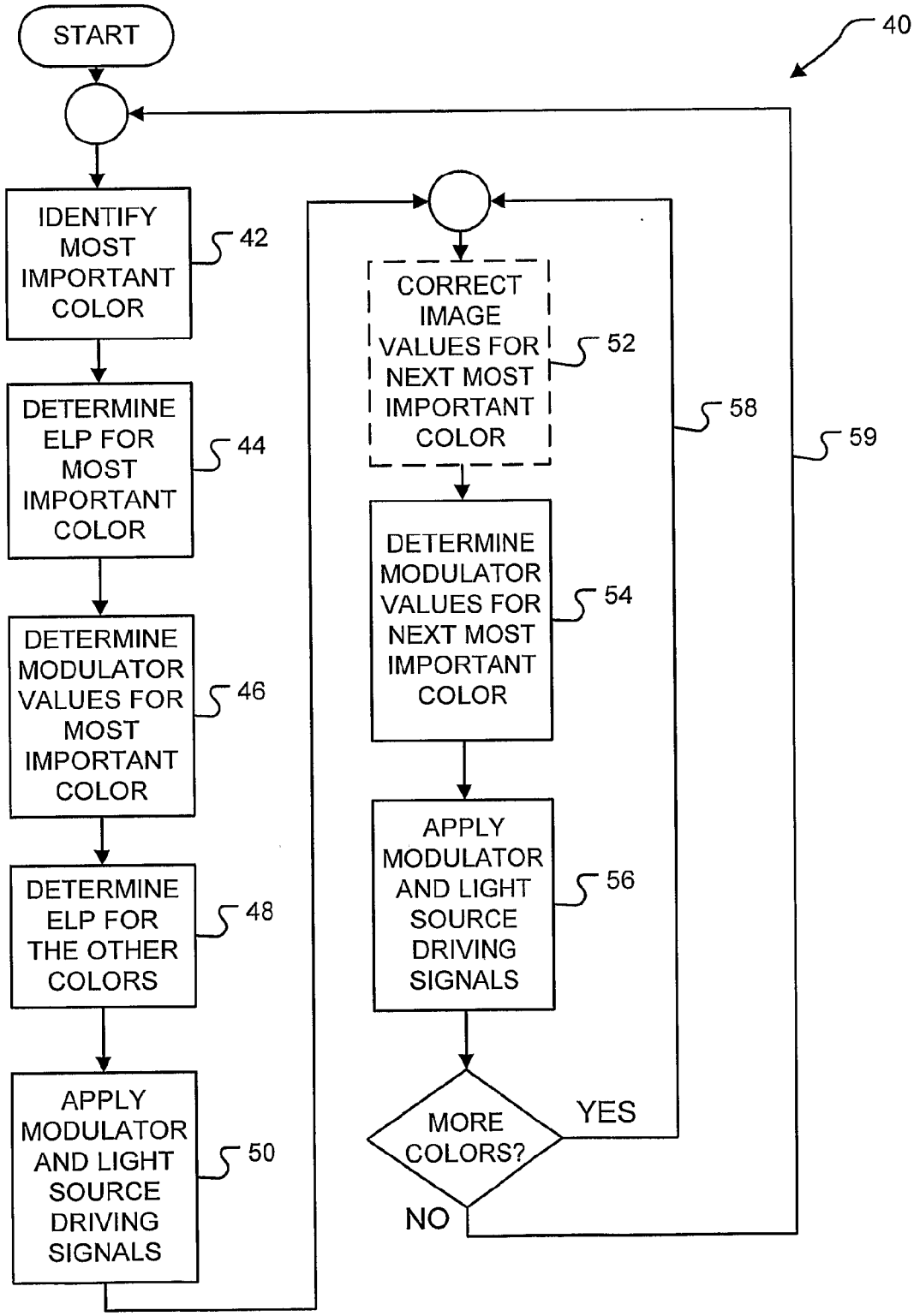

FIG. 3 shows an alternative method 40 for displaying color images according to the invention. Method 40 may be practiced with apparatus as shown in FIG. 1. Method 40 is advantageous in situations where modulator 12 cannot be refreshed fast enough to practice method 30 without undesirable flicker.

Method 40 may be practiced separately for different parts of the active area of modulator 12. Each part of the active area is illuminated by a cluster of light sources of array 14 that include light sources of all of the different colors represented in array 14. In block 42 method 40 determines the color that is most important for the part being considered. Preferably block 42 ranks colors from the most important color for the part (ranked first) to the least important color for the part.

Which color is "most important" may be determined in any suitable manner. For example, the colors may be ranked according to any one of or any combination of the following:

- Which colors have the highest average brightness per pixel in the part. The color having the highest average brightness in the part is ranked first. Colors having higher average brightness are ranked higher than colors having lower average brightness. The average brightness may be determined for example, by summing the brightnesses for each color for each pixel in the part.
- Which colors have the highest average pixel values in the part as specified in the signals. The color having the highest average pixel value is ranked first. Colors having higher average pixel values are ranked higher than colors having lower average pixel values. The average pixel values may be determined for example, by summing the pixel values for each color for each pixel in the part. The pixel values are related to brightness by scaling factors that take into account the fact that the human visual system is more sensitive to some colors than it is to others.
- Which colors have the maximum brightness for any pixel in the part. Colors having higher maximum brightness are ranked higher than colors having lower maximum brightness.
- Which colors have the maximum pixel value for any pixel in the part. Colors having higher maximum pixel values are ranked higher than colors having lower maximum pixel values.
- Which color has the maximum variation in brightness or pixel value or some combination of brightness and pixel value over the part. The variation may be a range which may be determined by subtracting the minimum brightness for a color in the part from the maximum brightness for the color in the part or another measure of variation. Colors having greater variation in the part are ranked higher than colors having smaller variations in the part.
- Which color exhibits the greatest degree of spatial clustering in the part. Colors having greater degrees of spatial clustering in the part may be assigned higher priorities than colors exhibiting smaller degrees of spatial clustering in the part. Where a large number of contiguous pixels in the part have similar pixel values for a color then the color has a large degree of spatial clustering.

Where more than one of the above factors are used to rank colors for a part of the active area of modulator 12 then any suitable weighting of the different factors may be used. Those skilled in the art will understand that the weighting may be fine tuned to provide the best reproduction of images of a certain type or to provide desired effects.

In block 44, a desired effective luminance pattern (ELP) is established for the most important (highest ranked) color identified in block 42. The ELP may be established in any suitable manner. For example, the ELP may be established as described above.

Block 46 determines modulator values for the most important color. The modulator values may be determined by dividing a desired luminance for each pixel in the part (as specified by image data 11) by the luminance for that pixel provided by the ELP established in block 44.

Block 48 determines desired ELPs for the other colors of light sources in array 14. The ELPs for the other colors may be obtained approximately by dividing the desired luminance for each pixel (as specified by image data 11) by the modulator values determined in block 46 for the most important color.

Block 50 generates and applies to modulator 12 a modulator control signal which controls the pixels of modulator 12 to have the values determined in block 46 and generates and applies to array 14 light source control signals which cause the light sources 16 of array 14 to illuminate the active area of modulator 12 with light having intensity that, for each color, varies over the active area of modulator 12 according to the ELP for that color determined in block 44 or 48.

Blocks 44 to 50 ensure that, for each part of modulator 12, the most important color identified in block 42 is accurately represented since the ELP and modulator values are both selected for that most important color. The most important color may be different in different parts of modulator 12. Other colors in the image of image data 11 are reproduced approximately.

In many cases, the image displayed by performing blocks 42 to 50 will be fairly accurate because, in typical images, it is common for some parts of the image to be single-colored. In single-colored parts of the image only the most important color needs to be represented. Further, in typical images, some parts of the image will be gray. In parts of the image that are predominantly a shade of gray, similar modulator values would be selected for all of the colors and so, in grey parts, using a modulator value determined for the most important color is also reasonably accurate for other lower-ranked colors.

Block 54 determines modulator values for each part of modulator 12 for the second most important color in the part. The modulator values may be determined in the same manner that modulator values for the most important color are determined in block 46. In block 56, driving signals are delivered to array 14 and modulator 12. Modulator 12 is driven with the driving signals which set the pixels of modulator 12 to the modulator values determined in block 54 for the second most important color in each part.

As noted above, block 50 usually does not perfectly reproduce the image specified by image data 11 for colors other than the color identified as the most important color. In block 50, in some pixels a lower ranked color may be brighter than specified by image data 11, while in other pixels the color may be dimmer than specified by image data 11.

Block 56 may optionally compensate for the errors in reproduction of the second most important colors. In the illustrated embodiment, this is done by applying correction factors to the pixel values for the second most important color in block 52. Pixel values modified by the correction factors are used in block 54 to determine the modulator values for the color. For example, if block 50 results in the intensity of a second most important color in a pixel being 15% greater than specified by image data 11 then block 52 may apply a correction factor to the pixel value for the second most important color so that in block 56 the intensity of the second most important color for that pixel is reduced by 15%.

For example, consider a pixel for which image data 11 specifies RGB values of 200, 100, 50. In the part of modulator 12 in which the pixel is located, the colors are ranked in the order: red, green blue. Suppose, block 50 actually causes the light intensities of the pixel to have the values red: 200; green: 80; and blue: 60. If block 52 were not performed then, in block 56 the green intensity of the pixel would be 80 instead of the desired value 100. By performing block 52 the intensity of green light emitted by the pixel in block 56 can be increased to compensate for the fact that the green intensity of the pixel was lower than desired in block 50. For example, block 52 could adjust the desired value for the pixel so that the green intensity of the pixel in block 56 is 120 instead of 100. The green intensity of the pixel will then average to the desired value of 100.

In cases where loop 58 is performed for a tertiary color then the correction of block 52 should be determined to obtain the desired value for each color averaged over block 50 and all repetitions of block 56.

It can be appreciated that method 40 sequentially changes the values for the pixels of modulator 12. Except in unusual cases (for example, monochrome images) array 14 provides light of all colors for each setting of modulator 12. For an embodiment in which there are three colors with correction provided for all colors, for each color, the accuracy with which that color component of the image is displayed varies across subsequent frames as: "perfect"→"average"→"average"→perfect" etc. In a pure field sequential display method, each color is displayed only during a sub-frame during which the color is properly displayed. However, the color is "off" in other sub-frames.

For each color, with a method such as method 40 the net variation in intensity between subsequent frames or sub-frames will thus be much smaller most of the time than in a pure field sequential display method. The reduced fluctuation in color intensity as compared to pure field sequential methods makes it possible to operate at reduced frame rates while avoiding artefacts that result from large fluctuations in the intensity of a color, such as color break up. For example, method 40 may be practiced so that subsequent display blocks 50 and 56 are performed at a low rate. For example, less than 110 Hz. The rate is as low as 50-60 Hz in some embodiments. Method 40 can provide benefits in perceived image quality at higher rates as well.

Block 52 may limit the amount of correction provided to avoid undesirable flicker. If for example, a single pixel of the second-ranked color is dimmer than it should be by 80%, increasing the brightness of that pixel by 80% in the next frame could cause undesirable perceptible flicker. Block 52 may simply cut off compensation at a certain point, for example, block 50 may clip the intensity of a pixel at 150% of its pixel value. In the alternative, block 52 may implement a non-linear correction scale such that small corrections are made completely whereas larger corrections are reduced. For example, an adjustment table such as Table I may be provided.

TABLE I

EXAMPLE NON-LINEAR CORRECTION TABLE

| Amount too dim in first frame | Amount of increase in next frame |
|---|---|
| 10% | 10% |
| 30% | 25% |
| 50% | 35% |
| 60% | 45% |

Optionally block 52 determines a new ELP for the second most important color. Typically this is not necessary as in many real images the correction factors will be small enough that the corrected brightness for the pixel can be achieved by varying modulator values.

In some embodiments, blocks 52 to 56 are repeated for colors of tertiary or lower ranking as indicated by loop 58. After all desired repetitions of blocks 52 to 56, method 40 loops back to block 42 as indicated by line 59. In some embodiments, for at least some least important colors, modulator values are not set.

In some embodiments of the invention, block 54 ensures that the modulator values do not differ from the most recent previous modulator values by more than some threshold amount. This may be done on a pixel-by-pixel basis or for larger parts of the active area. Preventing the modulator values from changing too radically between block 50 and block 56 (or between sequential iterations of block 56) can help to avoid perceptible flicker.

Where method 40 is being used to display a sequence of frames that make up a video image, rather than a still image, blocks 50 and each repetition of block 56 (if block 56 is repeated e.g. for secondary and tertiary colors) may display a separate frame of the video sequence. In the alternative, if modulator 12 can be switched fast enough, blocks 50 and 56 may be repeated for each frame of the video sequence.

In some embodiments of the invention, only less important colors are corrected as described above. The most important colors may each be displayed in a separate sub frame. For example, consider a case where the colors in a part are ranked in order red, green, blue. In a first sub-frame array 14 could illuminate modulator 12 with red light only. The signals driving modulator 12 could be selected to properly reproduce the red color. In a second sub-frame, array 14 illuminates modulator 12 with green and blue light only. The signals driving modulator 12 could be selected to properly reproduce green. The level of blue could be corrected in subsequent frames, as described above. In such embodiments, modulator 12 should operate quickly enough that flicker is not perceptible. For example, modulator 12 may be operated at a rate of 120 Hz or more so that the two most important colors (red and green in this example) are both properly displayed inside one 60 Hz frame. Less important colors are corrected over subsequent frames.

Software for implementing the invention may provide adjustable parameters which control things such as the amount of variation permitted for any pixel between sequential frames; the maximum amount of correction for a color provided in a frame; the method by which colors are ranked; the manner in which the active area of the modulator is divided into parts; and so on.

Certain implementations of the invention comprise computer processors which execute software instructions which cause the processors to perform a method of the invention. For example, one or more processors in a display driver 19 may implement the methods of FIG. 1A, 1B or 3 executing software instructions in a program memory accessible to the processors. The invention may also be provided in the form of a program product. The program product may comprise any medium which carries a set of computer-readable signals comprising instructions which, when executed by a computer processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, flash RAM, or the like or transmission-type media such as digital or analog communication links.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. For example:

- The methods of this invention may be applied in cases where there are two, three, four or more colors.
- The parts of the active area of modulator 12 within which the most important colors are identified do not necessarily correspond with one cluster of light sources in array 14. For example, where array 14 comprises a plurality of clusters each having one red, one green and one blue light source, the parts over which block 42 of method 40 determine the most important color may correspond to one or several such clusters of light sources. In some embodiments of the invention acceptable performance may be achieved by treating the entire active area of modulator 12 as a single part so that the entire area of modulator 12 uses one color priority.
- Instead of determining color priority for parts of modulator 12 which include groups of pixels, color priority may be computed for "parts" which each include only one pixel. In such cases, what is the most important color for the pixel may be determined with reference to what color is specified by image data 11 as being brightest in that pixel.
- The "colors" discussed in each embodiment of the invention do not need to be "sharp" or "narrow bandwidth" primary colors. The colors could be blends of two or more primary colors. For example, method 30 (FIG. 1A) could work if a distinct combination of light sources of different colors were active in each block 32A, 32B, 32C to project the same luminance pattern onto the modulator. Having narrow bandwidth primaries tends to yield a wider color gamut. In some embodiments of the invention, ranking the colors may comprise identifying linear combinations of primary colors for each of the parts and treating the linear combinations as the most important, second most important, third most important, etc. colors. For example, for a specific part of a specific image, the most important color might be identified as an equal mixture of red and blue.
- The time intervals are not necessarily all equal in length.
- The modulator may comprise a number of separate modulators that each modulate a different part of an image.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A method for controlling a display to display an image specified by image data, the image data comprising a plurality of color channels, the display comprising a modulator located to be illuminated by light from a plurality of groups of light sources, the light sources of each group emitting light of a corresponding one of the plurality of colors, a spatial distribution of light from each of the groups of light sources on an active area of the modulator controllable by applying light source control signals to the light sources of the group, the method comprising:

processing the image data to select one of the plurality of colors which exhibits a greatest degree of spatial clustering in at least a part of the image;

based at least in part on the color channel of the image data corresponding to the selected color determining first pixel driving values for pixels of the modulator corresponding to at least the part of the image;

determining light source control signals for the light sources of one or more colors other than the selected color based on the first pixel driving values and color channels of the image data corresponding to the one or more colors other than the selected color; and applying the first pixel driving values to drive the pixels of the modulator to selectively allow light from the active area to pass to a viewing area and while applying the first pixel driving values to drive the pixels of the modulator:

operating the light sources of the selected color to illuminate the active area of the modulator with light of the selected color; and applying the light source control signals for the light sources of the one or more colors other than the selected color to drive the light sources of the one or more colors other than the selected color;

wherein selecting one of the plurality of colors which exhibits a greatest degree of spatial clustering is based on a determination of a number of contiguous pixels in the part of the image that have similar pixel values for each of the plurality of colors.

2. A method according to claim 1 comprising, based on the color channel for the selected color determining selected color light source control signals for the light sources of the selected color, wherein operating the light sources of the selected color comprises applying the selected color light source control signals to drive the light sources of the selected color to emit light of the selected color with a spatial distribution at the modulator determined by the selected color light source control signals.

3. A method according to claim 2 comprising generating the first pixel driving values by steps that include:

estimating a first luminance pattern that would be produced on the modulator by driving the selected group of light sources with the selected color light source control signals; and, computing the first modulator values based upon the channel of the image data corresponding to the first color and the first luminance pattern.

4. A method according to claim 1 comprising, for each of a plurality of areas of the image selecting a different selected color and, for each of the plurality of areas performing the method using the selected color corresponding to the area.

5. A method according to claim 1 wherein:

applying the first pixel driving values to drive the pixels of the modulator is performed in a first time interval; and the method comprises, during a second time interval distinct from the first period, controlling the pixels of the modulator according to second pixel driving values based upon a color channel of the image data corresponding to a second one of the colors.

6. A method according to claim 5 comprising, while controlling the pixels of the modulator according to the second pixel driving values operating the groups of light sources corresponding to both of the selected and second colors.

7. A method according to claim 6 wherein:

applying the light source control signals for the light sources of the one or more colors other than the selected color comprises applying light source control signals for the group of light sources corresponding to the second color;

the method comprises, while controlling the pixels of the modulator according to the second pixel driving values driving the light sources of the group of light sources corresponding to the second color with new light-source control signals different from those used to drive the light sources of the group of light sources corresponding to the second color while controlling the pixels of the modulator according to the first pixel driving values.

8. A method according to claim 7 comprising generating the new light-source control signals from the color channel of the image data corresponding to the second color.

9. A method according to claim 7 comprising generating the second pixel driving values by steps that include:

determining a set of correction factors for the second color based upon a difference between the values specified in the image data for the second color and estimated light output values for the second color in the first time interval; and generating the second modulator values based at least upon: the channel of the image data corresponding to the second color, the correction factors, and an estimated luminance pattern for the second color.

10. A method according to claim 9 wherein the set of correction factors include correction factors for each pixel in an area of the modulator.

11. A method according to claim 9 wherein generating the second modulator values comprises setting the second modulator values so that the second modulator values do not differ from the first modulator values by more than a threshold amount.

12. A method according to claim 5 comprising, during at least one of the first and second time intervals, operating a third one of the groups of light sources to create on the modulator a luminance pattern in a third color.

13. A method according to claim 5 wherein the first and second time intervals occur within a cycle that is repeated and wherein, during each cycle, none of the modulator values are based upon the values specified by the image data for a least-important one of the colors.

14. A method according to claim 5 wherein the first and second time intervals both occur in a cycle that repeats at a rate not exceeding 110 Hz.

15. A method according to claim 1 performed in a repeating cycle wherein the cycle comprises a plurality of time intervals, in one of the time intervals:

operating only the group of light sources corresponding to the selected color to provide a luminance pattern on the modulator; and, controlling the pixels of the modulator to have modulator values based upon values specified in the image data for the selected color;

and in another of the time intervals:

operating two or more of the groups of light sources to provide a corresponding plurality of overlapping luminance patterns on the modulator; and controlling the pixels of the modulator to have modulator values based upon values specified in the image data for colors corresponding to one of the two or more groups of light sources being operated.

16. A method according to claim 1 wherein the image data comprises video data comprising a plurality of frames and the method is repeated for each of the frames of the video data.

17. A method according to claim 16 wherein the modulator is a monochrome modulator.

18. A method according to claim 1 wherein point spread functions of different ones of the light sources in each of the groups overlap with one another at the modulator.

19. A method according to claim 1 wherein processing the image data to select one of the plurality of colors comprises computing for each of the plurality of colors a weighted combination of the degree of spatial clustering with one or more of: average brightness per pixel, highest average pixel value, maximum brightness for any pixel, maximum pixel value for any pixel and maximum variation in brightness or pixel value.

20. A method according to claim 1 comprising simultaneously driving the light sources of each group of light sources to emit light for each setting of the modulator.

* * * * *